US008097127B2

(12) United States Patent
Saastamoinen et al.

(10) Patent No.: US 8,097,127 B2
(45) Date of Patent: Jan. 17, 2012

(54) SILICEOUS COMPOSITION AND ITS USE IN PAPERMAKING

(75) Inventors: Sakari Saastamoinen, Hämeenlinna (FI); Tero Seppala, Kuusankoski (FI); David Robert Cordier, Chesapeake, VA (US); Christian Bruce Edmonds, Rincon, GA (US)

(73) Assignee: BASF SE, Ludwigshafen (DE)

( * ) Notice: Subject to any disclaimer, the term of this patent is extended or adjusted under 35 U.S.C. 154(b) by 242 days.

(21) Appl. No.: 12/440,966

(22) PCT Filed: Sep. 13, 2007

(86) PCT No.: PCT/EP2007/059618

§ 371 (c)(1), (2), (4) Date: Mar. 12, 2009

(87) PCT Pub. No.: WO2008/037593

PCT Pub. Date: Apr. 3, 2008

(65) Prior Publication Data

US 2009/0236065 A1 Sep. 24, 2009

Related U.S. Application Data

(60) Provisional application No. 60/934,271, filed on Jun. 12, 2007.

(30) Foreign Application Priority Data

Sep. 27, 2006 (GB) ..... 0619035.9

(51) Int. Cl.

| | |
|---|---|
| ***D21H 17/68*** | (2006.01) |
| ***D21H 17/69*** | (2006.01) |
| ***C01B 33/14*** | (2006.01) |
| ***C01B 33/18*** | (2006.01) |
| ***C01B 33/20*** | (2006.01) |

(52) U.S. Cl. ..... 162/181.6; 162/158; 162/164.1; 162/181.1; 162/181.7; 162/185; 516/110; 516/111; 423/338

(58) Field of Classification Search ..... 162/158, 162/164.1, 168.1, 181.7, 181.6, 181.1, 185; 516/110, 111; 423/330.1, 332, 338
See application file for complete search history.

(56) References Cited

U.S. PATENT DOCUMENTS 3,630,954 A * 12/1971 Yates ..... 516/83

(Continued)

FOREIGN PATENT DOCUMENTS

EP 0464289 1/1992

(Continued)

OTHER PUBLICATIONS

Moffett, "On-site production of a silica-based microparticle retention and drainage aid" TAPPI Journal, vol. 77, No. 12, 1994, pp. 133-138.*

(Continued)

*Primary Examiner* — Matthew Daniels
*Assistant Examiner* — Dennis Cordray
(74) *Attorney, Agent, or Firm* — Drinker Biddle & Reath

(57) ABSTRACT

An aqueous polysilicate composition comprising a polysilicate microgel based component in association with particles derived from colloidal polysilicate. The invention also concerns a process for preparing an aqueous polysilicate composition comprising mixing an aqueous colloidal polysilicate with an aqueous phase of a polysilicate microgel. The aqueous polysilicate composition is more effective than colloidal silica and is more stable than a conventional polysilicate microgel.

19 Claims, 4 Drawing Sheets

U.S. PATENT DOCUMENTS

| | | | | |
|---|---|---|---|---|
| 4,388,150 | A | 6/1983 | Sunden et al. | |
| 4,954,220 | A | 9/1990 | Rushmere | |
| 5,176,891 | A | 1/1993 | Rushmere | |
| 5,312,595 | A | 5/1994 | Moffett et al. | |
| 5,470,435 | A | 11/1995 | Rushmere et al. | |
| 5,482,693 | A | 1/1996 | Rushmere et al. | |
| 5,503,820 | A | 4/1996 | Moffett et al. | |
| 5,603,805 | A * | 2/1997 | Andersson et al. | 162/168.3 |
| 5,643,414 | A * | 7/1997 | Johansson et al. | 162/164.6 |
| 5,648,055 | A | 7/1997 | Moffett et al. | |
| 5,707,494 | A | 1/1998 | Rushmere et al. | |
| 5,853,616 | A | 12/1998 | Moffett et al. | |
| 5,980,836 | A | 11/1999 | Moffett et al. | |
| 6,060,523 | A | 5/2000 | Moffett et al. | |
| 6,274,112 | B1 | 8/2001 | Moffett et al. | |
| 6,372,805 | B1 | 4/2002 | Keiser et al. | |
| 6,372,806 | B1 * | 4/2002 | Keiser et al. | 516/82 |
| 6,379,500 | B2 * | 4/2002 | Greenwood et al. | 162/181.6 |
| 6,395,134 | B1 | 5/2002 | Chen et al. | |
| 6,406,593 | B1 | 6/2002 | Heard et al. | |
| 6,454,902 | B1 | 9/2002 | Chen | |
| 2002/0066540 | A1 | 6/2002 | Chen et al. | |
| 2002/0198306 | A1 * | 12/2002 | Carr et al. | 524/492 |
| 2003/0025103 | A1 * | 2/2003 | Persson et al. | 252/194 |
| 2004/0052901 | A1 * | 3/2004 | Jacquinot et al. | 426/11 |

FOREIGN PATENT DOCUMENTS

| | | | |
|---|---|---|---|
| EP | 1388522 | | 2/2004 |
| JP | 54-090100 | A * | 7/1979 |
| WO | 9525068 | | 9/1995 |
| WO | 9830753 | | 7/1998 |
| WO | 9856715 | | 12/1998 |
| WO | 9916708 | | 4/1999 |
| WO | 0066491 | | 11/2000 |
| WO | 0075074 | | 12/2000 |
| WO | 0134907 | | 5/2001 |
| WO | 0134909 | | 5/2001 |
| WO | 0134910 | | 5/2001 |
| WO | 0233171 | | 4/2002 |

OTHER PUBLICATIONS

Derwent Abstract of JP 54-090100, 1979.*
Tappi Journal, (Dec. 1994) vol. 77, No. 12, pp. 133-138.
Journal of Analytical Chemistry vol. 28, No. 12, (Dec. 1956), pp. 1981-1983.
Great Britain Search Report dated Jan. 29, 2007.

* cited by examiner

SILICEOUS COMPOSITION AND ITS USE IN PAPERMAKING

This application is a 371 of PCT/EP2007/059618, filed Sep. 13, 2007 and claims priority to U.S. Provisional Application 60/934,271, filed Jun. 12, 2007 and to UK Application No. 0619035.9, filed Sep. 27, 2006.

The present invention relates to an aqueous polysilicate composition and its preparation. Also included in the present invention is a process of making paper and paperboard in which the aqueous polysilicate composition is included as part of a flocculation system.

It is known to employ polysilicate microgels as part of the retention or drainage system in the manufacture of paper or paperboard. One method of making polysilicate microgels and their use in paper making processes is described in U.S. Pat. No. 4,954,220. A review of polysilicate microgels is described in the December 1994 Tappi Journal (vol. 77, No 12) at pages 133 to 138. U.S. Pat. No. 5,176,891 discloses a process for the production of polyaluminosilicate microgels involving the initial formation of a polysilicic acid microgel followed by the reaction of this microgel with an aluminate to form the polyaluminosilicate. The use of such polyaluminosilicate microgels in the manufacture of paper is also described.

The preparation of the polyaluminosilicate microgel described in U.S. Pat. No. 5,176,891 involves three steps the first of which is the acidification of an aqueous solution of alkali metal silicate to form a polysilicic acid microgel. Secondly a water-soluble aluminate is added to this polysilicic acid microgel to form the polyaluminosilicate microgel and then finally this is diluted to stabilise the product against gelation.

WO 95/25068 describes an improved method of making polyaluminosilicate microgels over the process of U.S. Pat. No. 5,176,891 in that the micro gels are prepared by a two-step process. Specifically the process involves acidifying an aqueous solution of an alkali metal silicate containing 0.1 to 6% by weight of $SiO_2$ to a pH of 2 to 10.5 by using an aqueous acidic solution containing an aluminium salt. The second essential step is the dilution of the product of the first step prior to gelation to a $SiO_2$ content of no more than 2% by weight. In the absence of a dilution step the polyaluminosilicate microgel would gel in a matter of minutes. Even after dilution to as low as 1% these microgels are only stable for a few days and therefore must be used within this time otherwise the product would become a solid gel.

WO 98/30753 described a process of making polyaluminosilicate microgels by a process which eliminates the dilution step. Instead of diluting the polyaluminosilicate the pH is adjusted to between 1 and 4 and thus allowing the microgels to be stored at much higher concentrations at up to 4 or 5 weight %. However, although this process allows a more concentrated product to be produced, in practice the stability of the product tends not to be significantly better and again the product must be consumed within a few days otherwise it would become a gel. Furthermore, the stability tends to decrease as the pH approaches the upper value of 4.

The aforementioned polysilicate microgel products tend to be manufactured on-site since shipping of such products may not allow sufficient time for them to be delivered to the paper mill and consumed before the product has gelled. Furthermore, it may not be economically viable to ship the diluted microgels of solids concentration no more than 2%.

WO 98/56715 seeks to provide a polysilicate microgel that is more storage stable and has a higher concentration. The high concentration polysilicate and aluminated polysilicate microgels involve mixing an aqueous solution of alkali metal silicate with an aqueous phase of silica based material preferably having a pH of 11 or less. The alkali metal silicate used to prepare the polysilicate microgels are said to be any water-soluble silicate salt such as sodium or potassium silicate. The silica based material which is mixed with the alkali metal silicate solution can be selected from a wide variety of siliceous materials and include silica based sols, fumed silica, silica gels, precipitated silicas, acidified solutions of alkali metal silicates, and suspensions of silica containing clays of the smectite type. Although it is stated that the pH of the silica based material is between 1 and 11 it is it is also revealed that most preferably it is between 7 and 11. The pH of the polysilicate microgel is said to be generally below 14 although usually is above 6 and suitably above 9. Microgels are exemplified showing pH values greater than 10. Example 2 shows the stability of the microgels 1, 3, 5 or 10 days after preparation.

An objective of the present invention is to provide a siliceous product that is an effective retention or drainage aid and yet has significantly longer storage stability than conventional polysilicate microgels. It is also an objective to produce an effective siliceous material for papermaking that has significantly higher silica solids content than many conventional polysilicate microgels. It would also be desirable to provide such a storage stable, higher solids product that is more effective than conventional colloidal polysilicate.

According to the present invention we provide an aqueous polysilicate composition comprising a polysilicate microgel component which is in association with particles derived from colloidal polysilicate. Such a composition may be termed a composite.

Figure 1:
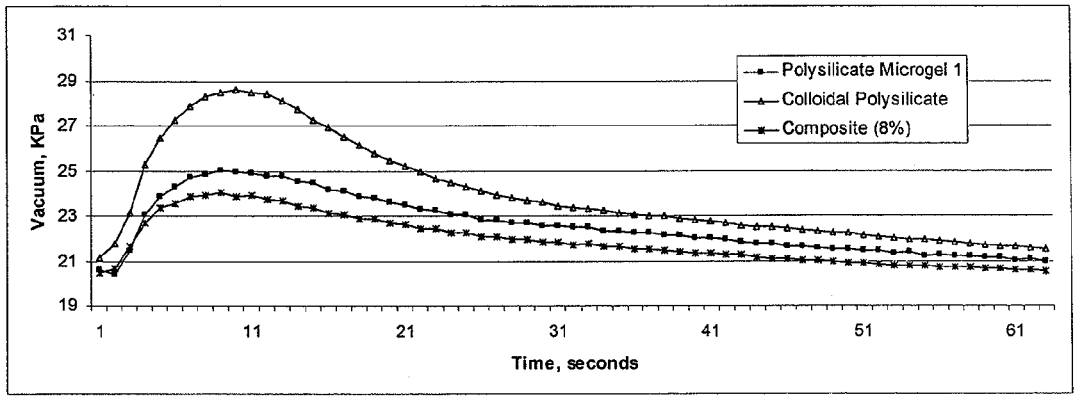
FIG. 1: a graph of dewatering values when using cationic polyacrylamide with siliceous material selected from conventional colloidal polysilicate, polysilicate microgel, and an 8% polysilicate composition.

Preferably the polysilicate composition has a pH of between 1.5 and 5.5.

Preferably the polysilicate composition has a viscosity of below 500 mPa·s measured using a Brookfield RVT viscometer at 100 rpm at 25° C.

The association between the polysilicate microgel component and particles derived from colloidal silica may comprise covalent bonding, for instance as Si—O—Si bond linkages, which may occur by the reaction between condensation reaction of two silanol (silicic acid) end groups.

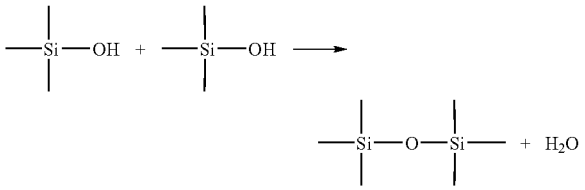

However, the association can be other types of association that result in attraction between the microgel particles and the silica particles from colloidal silica. The association may for instance comprise ionic association or alternatively the particles from the colloidal silica may become physically bound up with the microgel.

The pH is preferably within the range of 1.5 to 5.5 but more preferably is between 3 and 5. Unexpectedly we have found that the silica composition is more stable for a greater period of time in this range, particularly as the pH approaches 5.

The aqueous silica composition of the present invention should have sufficient fluidity such that it can easily be pumped. Preferably it will have a viscosity of below 450 mPa·s and usually the viscosity will be below 400 mPa·s. More desirably the viscosity will be considerably lower, for instance below 300 or below 250 mPa·s and especially below 150 mPa·s. Nevertheless the viscosity of the silica composition may be water thin and exhibit a viscosity of at least 1 mPa·s. Typically the composition will often exhibit a viscosity of between 5 and 50 mPa·s, often between 20 and 40 mPa·s when freshly prepared. The product of the invention will remain storage stable (i.e. a fluid) for at least a week and preferably at least two weeks and most preferably at least one month. The silica composition may remain stable for up to two months or more. During the period of storage the viscosity may increase but will not gel and generally will remain below 500 mPa·s, and preferably substantially below this, especially below 150 mPa·s, for instance within the range of 20 to 150 mPa·s.

The viscosity is measured using a Brookfield RVTDV-II viscometer using spindle 2 at 100 rpm at 25° C.

Surprisingly the presence of the particles derived from colloidal silica appear to be responsible for improving the stability of the microgel. Without being limited to theory it is believed that the presence of these silica particles in the association with the microgel may induce steric hindrance preventing gelation or at least significantly reducing the rate of gelation while the silica composition is in a more concentrated form. Nevertheless, we find that on dilution and/or addition to the paper making stock (cellulosic suspension) the silica composition is sufficiently active so as to function effectively as a retention or drainage aid.

Generally the $SiO_2$ solids content of the polysilicate composition will be above that achievable by conventional processes of making microgels (i.e. no more than 2% by weight) in preparation, although the silica composition may be diluted when utilised in a paper making process. Usually the concentration of the silica composition prepared will be at least 3% and preferably at least 4% by weight. More preferably the $SiO_2$ content will be at least 5.5% by weight and may be as high as 15 or 20% by weight or higher. Often the $SiO_2$ solids content could be in the range of 5.5 to 12% by weight.

The silica composition according to the present invention usually will have a volume average particle size diameter of at least 20 nm. Often the average particle size will be considerably larger and may be as high as 120 nm or greater. Preferably it will be at least 25 nm typically within the range of 30 to 100 nm, especially 40 to 90 nm. Volume average particle size diameter can be determined using a Malvern nano ZS with MPT-2 autotitrator. Conditions: temperature 20° C. and used duration 60 seconds.

In some cases the aqueous polysilicate composition may contain essentially only the polysilicate composition particles distributed throughout the aqueous medium. However, the aqueous polysilicate composition may in some cases be an aqueous mixture of composition particles and unassociated polysilicate microgel particles. In other cases the aqueous composition may contain a mixture of associated particles and unassociated silica based particles derived from the colloidal silica. The aqueous polysilicate composition may comprise silica associated particles, some unassociated microgel and some unassociated colloidal silica derived particles all dispersed in the aqueous medium. The structure of the silica composition particles is believed to contain microgel particles which are comprised of primary particles often in the region of 1 to 2 nm joined together as the polyparticulate microgel of size at least 20 nm and often considerably larger, for instance up to 120 nm. The colloidal silica derived particles may be arranged within the open structure of the microgel or arranged around the microgel in association. In one form the polysilicate microgel particles may coat the particles of colloidal silica. Generally the colloidal silica derived particles will be larger than the primary particles of the microgel but smaller than the polyparticulate microgel. Typically the particles may have a size in the region of 3 to 10 nm, often 4 or 5 nm. The polysilicate composition may have a single mode distribution of particle sizes or alternatively it may be a bimodal distribution. The particle sizes of the components of the silica composition can be determined by applying methods that use laser backscattering.

In accordance with the present invention we also provide a process for preparing an aqueous polysilicate composition. The process involves mixing an aqueous colloidal polysilicate with an aqueous phase of a polysilicate microgel.

The polysilicate microgel may have an active $SiO_2$ content of up to 4 or 5 weight %, particularly if it has been prepared according to WO 98/30753 which avoids a dilution step. Nevertheless whichever method of preparing the microgel is used, when employed in the process of the present invention it may often have an active $SiO_2$ content of no more than 2% by weight. Generally the microgel composition will tend to be acidic (i.e. of pH below 7) and typically will be in the range of between pH 1 and 4. Generally the surface area of the microgel will be at least 1000 $m^2/g$. Preferably this will be in the range of 1200 to 1700 $m^2/g$.

The aqueous colloidal polysilicate that is used in the process should have an active $SiO_2$ content above that of the microgel and generally this will be at least 10% by weight and preferably at least 14 or 15% by weight. The $SiO_2$ content may be as high as 25% or higher but in general will be no higher than 20% by weight. Usually the aqueous colloidal polysilicate has a pH above 7 and generally above 8 and may be as high as 10.5 or higher but is preferably it is within the range of 8.5 and 10.0.

The colloidal polysilicate used in accordance with the present invention will generally possess a surface area below 1000 $m^2/g$ and frequently significantly lower, for instance below 700 $m^2/g$. Typically the surface area will be greater than 200 $m^2/g$ and usually more than 300 $m^2/g$. The surface area will normally be between 400 and 600 $m^2/g$, for instance 450 to 500 $m^2/g$. The surface area can be determined using the Sears titration method as described in the Journal of Analytical Chemistry, Vol 28, No. 12 December 1956 pages 1981 to 1983.

The colloidal polysilicate may be aluminated, for instance by surface treating the particles of polysilicate by a suitable aluminium compound, for instance Na aluminate.

In the process of preparing the aqueous polysilicate composition the aqueous colloidal polysilicate is preferably added to the aqueous phase of the polysilicate microgel. It is often preferable to then adjust the pH to between 1.5 and 5.5. In some cases it may be desirable to adjust the pH to between 1.5 and 3 and in other instances desirable results are obtained when the pH is adjusted to between 3 and 5. More preferably, the aqueous colloidal polysilicate and the aqueous polysilicate micro gel are mixed together and a period of at least 2 minutes is allowed to elapse before pH adjustment. More preferably still, the pH is adjusted after a period of at least 5 minutes, in particular at least 10 minutes and most preferably at least 20 minutes. The combination of aqueous, the polysilicate and aqueous polysilicate micro gel may be adjusted in pH after a longer period of time, for instance up to two hours or more. Nevertheless, the pH adjustment will normally be carried out in a period up to 90 minutes and usually not more than 60 minutes.

In general the aqueous polysilicate composition of the present invention may have an S-value of 10 to 60%, for instance in the region of 35 to 55%.

This can be achieved using an ion exchange resin or the addition of an acid or acid precursor such as carbon dioxide. Preferably the acid has a pKa of below 4 and preferably below 2 when measured and 25° C. The acid may be any suitable acid capable of bringing the pH to within the required range and preferably is a strong mineral acid, such as sulphuric acid or hydrochloric acid. Nevertheless, in some cases it may not be necessary to acidify since depending upon the ratios of aqueous polysilicate and polysilicate micro gel the resulting pH may be within the range of 1.5 to 5, preferably 3 to 5, without any further acidification.

Unexpectedly this combination of polysilicate micro gel with colloidal polysilicate does not form a solid gel even though the pH can be in the range of 1.5 to 5 since the unreacted colloidal polysilicate at this pH would readily form a gel.

The ratio of the polysilicate microgel to the aqueous colloidal polysilicate suitably may be within the range of 1:99 and 99:1 by weight of active silica Preferably the ratio will be within the range of 1:1 and 1:60, more preferably 1:5 to 1:50 and most preferably 1:15 to 1:45.

Preferably the aqueous polysilicate microgel would be introduced into a suitable reaction vessel first and then the aqueous colloidal polysilicate will be introduced and mixed with the aqueous polysilicate microgel. Alternatively the reverse order of addition may be applied or simultaneous addition of both components may be employed. In this reverse order it may often be preferable to acidify the aqueous colloidal polysilicate prior to the addition of the polysilicate microgel. In some cases it may be desirable to add boldly colloidal polysilicate and the polysilicate microgel simultaneously into the reactor vessel.

In a preferred form of the process the aqueous colloidal polysilicate is added into the aqueous polysilicate microgel by controlled addition. This may for instance involve introducing the aqueous colloidal polysilicate at substantially a constant rate, although a variable rate may be desired in some instances. In general the aqueous colloidal polysilicate will be added at a rate of at least 0.1 ml/s. In a large-scale industrial process it may be desirable to introduce the colloidal polysilicate at much higher rates, for instance up to 100 ml/s or higher. Preferably, the polysilicate will be introduced at a rate between 0.1 and 20 ml/s, frequently between 0.2 and 10 ml/s and more preferably between 0.5 and 5 ml/s and especially between 1 and 3 ml/s.

Desirably the aqueous polysilicate microgel is stirred or agitated continually during the addition of the colloidal polysilicate. The amount of stirring or agitation should be sufficient to enable the colloidal polysilicate to be distributed throughout the aqueous polysilicate microgel. The preparation of the aqueous polysilicate composition may use a conventional reactor vessel employing conventional means for introducing the aqueous polysilicate microgel and aqueous colloidal polysilicate and employing conventional impeller means to enable the appropriate amount of mixing. Other suitable vessels which allow introduction and mixing together of the components may be employed.

The polysilicate microgel may be prepared according to any of the known prior art, for instance U.S. Pat. Nos. 6,274,112, 6,060,523, 5,853,616, 5,980,836, 5,648,055, 5,503,820, 5,470,435, 5,482,693, 5,312,595, 5,176,891, 4,954,220, WO 95/25068 and WO 98/30753.

In a particularly preferred process the colloidal polysilicate is mixed into the polysilicate micro gel to provide a mixture that is at a neutral pH, preferably between 6 and 8, more preferably between 6.5 and 7.5. The colloidal polysilicate may be as defined above and preferably has a surface area within the range of 450 to 600 $m^2/g$, more preferably between 500 and 550. In addition the colloidal silica typically has a NaO level of between 0.4% and 0.8% for instance between 0.5 and 0.7%, and an active silica level of between 13 and 20% especially between 15 and 18%. The colloidal polysilicate may be surface treated although preferably it is not, but may contain trace amount of aluminium. The polysilicate micro gel may be any of the polysilicate microgels specified herein, although preferably it is prepared according to U.S. Pat. Nos. 6,274,112 and/or 6,060,523.

In this particularly preferred embodiment of the mixture of the colloidal polysilicate and polysilicate micro gel are acidified after a period of time. Preferably this will be at least 15 minutes and more preferably at least 20 minutes. The period may be as long as 90 minutes that is usually not longer than 50 or 60 minutes, especially up to 30 or 40 minutes. Alternatively, generally the mixture should be acidified when a suitable viscosity is reached. Normally this viscosity will be significantly below 100 mPa·s, especially in the range between 1 and 60 mPa·s and in particular within the range of 20 to 50 mPa·s.

The acidification may be carried out using any suitable means as defined herein and preferably is a strong mineral acid as defined previously. Acidification should be to a pH of between 1.5 and 3.5 and in particular between 1.5 and 2.5.

Unexpectedly, we have now that this particularly preferred embodiment provides a polysilicate composition that is almost or as effective as the constituent polysilicate micro gel. However, this product will generally contain a much lower quantity of micro gel and a much higher level of colloidal polysilicate component. In general the preferred products according to this particularly preferred embodiment will be prepared using between 10 and 30 weight % of polysilicate micro gel on an active silica basis, especially between 15 and 25% and between 70 and 90% colloidal polysilicate on an active silica basis, especially between 75 and 85%.

In general the aqueous polysilicate composition of the present invention, produced by this preferred embodiment, will have a silica solids content of between 3.5 and 20%, particularly preferably between 4.5 and 15%, and more particularly between 8 and 13%. The final pH of the products will generally be in the range of between 1.5 and 3.5, more preferably in the range of between 1.9 and 3.5. The S-value of the products according to this particularly preferred embodiment will be in the range of between 10 and 55%, especially between 16 and 44%.

The aqueous colloidal polysilicate may be any conventional colloidal polysilicic acid or silica sol, for instance has described in U.S. Pat. No. 4,388,150 or EP464289. The aqueous colloidal polysilicate may be a structured polysilicate, for instance having and S value of between 10 and 45%, for instance as described in WO00/66491 or WO00/66192 or WO2000075074. The aqueous colloidal polysilicate may be a borosilicate for instance as described in EP1023241, EP1388522 and commercially available structured silicas, such as BMA NP 780 (Trade Mark), BMA NP 590 (Trade Mark) and Nalco 8692 (Trade Mark).

The silica composition according to the present invention may be used as a flocculating agent in processes for production of paper or paperboard.

In a further aspect of the present invention we provide a process of making paper or paperboard comprising forming a cellulosic suspension, flocculating the suspension, draining the suspension on a screen to form a sheet and then drying the sheet, in which the suspension is flocculated using a flocculation system comprising i) an anionic, non-ionic, cationic or amphoteric polymer, and ii) the aqueous polysilicate composition as defined herein or optionally an aqueous dilution of said aqueous polysilicate composition. Preferably the polymer is either cationic or amphoteric.

The polysilicate composition and the anionic, non-ionic, cationic or amphoteric polymer may be introduced into the cellulosic suspension by any convenient method. It may be desirable to introduce both components simultaneously, either separately or as a combined mixture. Preferably the components of the flocculation system are introduced into the cellulosic suspension sequentially. In some cases it may be desirable to add the aqueous polysilicate composition to the cellulosic suspension prior to the addition of the anionic, non-ionic, cationic or amphoteric polymer. However, it is generally more preferable to add the polymer first and then the polysilicate composition.

The anionic, non-ionic, cationic or amphoteric polymers may be a conventional polymer used in papermaking processes as retention or drainage aids. The polymer may be linear, cross-linked or otherwise structured, for instance branched. Preferably the polymer is water-soluble.

The polymer can be any of the group consisting of substantially water-soluble anionic, non-ionic, cationic and amphoteric polymers. The polymers may be natural polymers such as starch or guar gums, which can be modified or unmodified. Alternatively the polymers can be synthetic, for instance polymers prepared by polymerising water-soluble ethylenically unsaturated monomers such as acrylamides, acrylic acid, alkali metal or ammonium acrylates or quaternised dialkyl amino alkyl-(meth) acrylates or -(meth) acrylamides. Usually the polymers will have a high molecular weight, such that the intrinsic viscosity is at least 1.5 dl/g. Preferably the polymers will have intrinsic viscosities of at least 4 dl/g and this may be as high as 20 or 30 dl/g. Typically the polymers will exhibit intrinsic viscosities of between 5 and 20 dl/g, for instance between 6 and 18 dl/g and often between 7 or 10 and 16 dl/g.

Intrinsic viscosity of polymers may be determined by preparing an aqueous solution of the polymer (0.5-1% w/w) based on the active content of the polymer. 2 g of this 0.5-1% polymer solution is diluted to 100 ml in a volumetric flask with 50 ml of 2M sodium chloride solution that is buffered to pH 7.0 (using 1.56 g sodium dihydrogen phosphate and 32.26 g disodium hydrogen phosphate per liter of deionised water) and the whole is diluted to the 100 ml mark with deionised water. The intrinsic viscosity of the polymers are measured using a Number 1 suspended level viscometer at 25° C. in 1 M buffered salt solution.

Water-soluble synthetic polymers may be derived from any water soluble monomer or monomer blend. By water soluble we mean that the monomer has a solubility in water of at least 5 g/100 cc at 25° C. In general the water-soluble polymers will satisfy the same solubility criteria.

When the polymer is ionic it is preferred that the ionic content is low to medium. For instance the charge density of the ionic polymer may be below 5 meq/g, preferably below 4 especially below 3 meq/g. Typically the ionic polymer may comprise up to 50% by weight ionic monomer units. When the polymer is ionic it may be anionic, cationic or amphoteric. When the polymer is anionic it may be derived from a water soluble monomer or monomer blend of which at least one monomer is anionic or potentially anionic. The anionic monomer may be polymerised alone or copolymerised with any other suitable monomer, for instance any water soluble nonionic monomer. Typically the anionic monomer may be any ethylenically unsaturated carboxylic acid or sulphonic acid. Preferred anionic polymers are derived from acrylic acid or 2-acrylamido-2-methylpropane sulphonic acid. When the water soluble polymer is anionic it is preferably a copolymer of acrylic acid (or salts thereof) with acrylamide.

When the polymer is nonionic it may be any poly alkylene oxide or a vinyl addition polymer which is derived from any water soluble nonionic monomer or blend of monomers. Typically the water soluble nonionic polymer is polyethylene oxide or acrylamide homopolymer.

The preferred cationic water soluble polymers have cationic or potentially cationic functionality. For instance the cationic polymer may comprise free amine groups which become cationic once introduced into a cellulosic suspension with a sufficiently low pH so as to protonate the free amine groups. Preferably however, the cationic polymers carry a permanent cationic charge, such as quaternary ammonium groups. Desirably the polymer may be formed from a water soluble ethylenically unsaturated cationic monomer or blend of monomers wherein at least one of the monomers in the blend is cationic. The cationic monomer is preferably selected from di allyl di alkyl ammonium chlorides, acid addition salts or quaternary ammonium salts of either dialkyl amino alkyl (meth) acrylates or dialkyl amino alkyl (meth) acrylamides. The cationic monomer may be polymerised alone or copolymerised with water soluble non-ionic, cationic or anionic monomers. Particularly preferred cationic polymers include copolymers of methyl chloride quaternary ammonium salts of dimethylaminoethyl acrylate or methacrylate.

When the polymer is amphoteric it will comprise both anionic or potentially anionic and cationic or potentially cationic functionality. Thus the amphoteric polymer may be formed from a mixture of monomers of which at least one is cationic or potentially cationic and at least one monomer is anionic or potentially anionic and optionally at least one nonionic monomer is present. Suitable monomers would include any of the cationic, anionic and nonionic monomers given herein. A preferred amphoteric polymer would be a polymer of acrylic acid or salts thereof with methyl chloride quaternised dimethyl amino ethyl acrylate and acrylamide.

The aqueous polysilicate composition is desirably mixed into the cellulosic suspension in an amount of at least 50 g per tonne, based on weight of polysilicate composition on dry weight of suspension. Preferably the amount will be at least 100 grams per tonne and can be significantly higher. We have found that for some systems optimum retention and drainage is achieved using doses as high as 3 kg per tonne or higher. In one preferred form the dose is in the range of 200 or 300 to 750 g per tonne. The aqueous polysilicate composition may be dosed into the cellulosic suspension in the form that is provided, for instance at a concentration of at least 4% $SiO_2$ by weight. However, it may be preferable to add the composition in more diluted form, for instance at a concentration of below 2% $SiO_2$ by weight. This could be come as low as 0.1% and in papermaking processes it may be desirable to use considerably lower concentrations, for instance as low as 0.01% active silica. Nevertheless, excessive dilution will generally not be required since the polysilicate composition mixes well into the papermaking stock.

The non-ionic, anionic, cationic or amphoteric polymer may be added in any suitable amount to bring about flocculation. Suitably the polymer will be added in amount of at least 20 and usually at least 50 or 100 grams per tonne, based on weight of active polymer on dry weight of suspension. The polymer may be added in as much as 1000 grams per tonne but is generally added in an amount not exceeding 700 grams per tonne. Preferred doses are usually within the range of 200 to 600 grams per tonne. Desirably the polymer may be added to the cellulosic suspension as an aqueous solution or dilution of the polymer. Typically the polymer may be dosed into the cellulosic suspension at a concentration of between 0.01 to 0.5%, usually around 0.05% to 0.1% by weight.

It may also be desirable to add cationic starch to a cellulosic suspension. This may be to improve retention or drainage or more likely so as to improve strength. Generally the cationic starch will be included prior to the addition of both the anionic, non-ionic, cationic or amphoteric polymer or the polysilicate composition. Nevertheless in some circumstances it may also be desirable to add the cationic starch later in the process, for instance after at least one of the components of the flocculation system. The cationic starch may be added in any convenient amount, for instance at least 50 g per tonne and usually considerably higher, such as at least 400 or 500 grams per tonne based on dry weight of suspension. The cationic starch may be added in an amount up to 5 kg per tonne or even higher. Often it will be added at between 1 and 3 kg per tonne. The cationic starch may be added into thin stock suspension or alternatively prior to dilution into the thick stock. In some cases it may be desirable to add cationic starch further back in the papermaking process, for instance into the blend chest or the mixing chest.

It may also be desirable to include a cationic material, for instance a cationic coagulant, into the cellulosic suspension. Typically such cationic materials may be relatively low molecular weight cationic polymers, usually of high cationic charge density and relatively low molecular weight, for instance below one million and often below 500,000. Such polymers may include the homopolymers of cationic monomers, including but not limited to diallyl dimethyl ammonium chloride (DADMAC), dimethyl amino ethyl acrylate, quaternised by methyl chloride (DMAEA.MeCl), dimethyl amino ethyl methacrylate, quaternised by methyl chloride (DMAEMA.MeCl), acrylamido propyl trimethyl ammonium chloride (APTAC) and meth acrylamido propyl trimethyl ammonium chloride (MAPTAC). Polyvinyl amines, prepared by hydrolysis of polyvinyl acetamide may be useful coagulants. Alternatively the coagulant polymers may be other than vinyl addition polymers, such as dicyandiamide polymers, polyethylene imine and the reaction products of epichlorohydrin with amines such as dimethyl amine. Other cationic materials include alum, polyaluminium chloride, aluminium chloro hydrate. Typically the cationic materials may be added in any convenient amount, for instance at least 50 grams per tonne and often as much as one or two kg per tonne based on the dry weight of cellulosic suspension. The cationic material may be added into the thin stock, the thick stock, the mixing chest, the blend chest and/or into the feed suspension.

In a particularly preferred way of operating the process the cellulosic suspension would be desirably flocculated by the addition of cationic or amphoteric polymer first. The flocculated suspension may then be subjected to mechanical degradation. In many cases this mechanical degradation will break the first formed flocs, that tend to be large and unstable, into smaller more stable aggregated structures, which may be termed micro flocs. Following the mechanical breakdown of the flocs the polysilicate composition would then be added in order to bring about further flocculation or aggregation of the mechanically degraded flocs. Mechanical degradation of the flocculated suspension may be achieved by passing it through one or more shear stages.

Typically shear stages capable of bringing about sufficient mechanical degradation include mixing, cleaning and screening stages. Suitably a shear stage may include one or more fan pumps or one or more centriscreens.

Generally both the aqueous polysilicate composition and the non-ionic, anionic, amphoteric or cationic polymer will be added to the thin stock suspension although in some cases it may be desirable to add either or both to the thick stock.

In one preferred process the polymer, preferably cationic or amphoteric polymer, is added to the thin stock prior to the centriscreen and in some cases prior to one or more of the fan pumps. The aqueous polysilicate composition is then desirably added after that shear stage. This may be subsequent to that shear stage but before any other shear stage or alternatively after two or more shear stages. For instance the polymer may be added prior to one of the fan pumps and the aqueous polysilicate composition may be added subsequent to that fan pump but before any subsequent fan pump and/or prior to the centriscreen or alternatively the polysilicate composition may be added after the centriscreen. In another desirable process the polymer is added prior to the centriscreen but after any of the fan pumps and the polysilicate composition is added after the centriscreen.

The polysilicate composition (composite) of the present invention can be used as a microparticulate material, as a replacement for or in conjunction with known silica compounds or swellable clay compounds. It may be desirable, for instance, to use the polysilicate composite as the siliceous material in any of the processes described by WO0233171, WO01 034910, WO01 034909 or as the anionic material used in WO01034907.

The following examples illustrate the invention.

EXAMPLE 1

Silica composition samples of this invention were prepared by slowly adding 450 g of a colloidal polysilicate which is 15% active $SiO_2$ by weight commercially available silica sol with a surface area of 450-500 $m^2/g$ and a pH value in the region of 8.5-9.5 to 150 g of a polysilicate microgel made according to U.S. Pat. No. 6,274,112 which has a surface area of 1200-1400 $m^2/g$ and a pH value in the region of 2 to 2.5 and an active silica content of 1.0%, with continuous stirring. The pH of the final silica composition samples was controlled by the addition of 93% sulphuric acid solution.

Three samples were prepared, sample 3, 5 and 6. The final pH values of the samples were 2.1, 4.4 and 5 respectively.

Table 1 shows the stability of the silica composition samples 3, 5 and 6 over a period of 1 month:

| | | Viscosity RVT 100 rpm | | | |
|---|---|---|---|---|---|
| Sample | pH | Time = 0 | I day | 7 days | 1 month |
| 3 | 2.1 | 21 | 25 | 42 | gel |
| 5 | 4.4 | 32 | 40 | 60 | 86 |
| 6 | 5.0 | 35 | 38 | 58 | 98 |

EXAMPLE 2

Test work was carried out on a moving belt former (MBF) using the polysilicate composition of the present invention by comparison to a polysilicate microgel and a colloidal polysilicate.

A furnish and clear filtrate from the machine chest of a coated freesheet machine was used for the first test and the filler used was Hydracarb 90 (GCC) and the level of filler used was 40%. For the second test a middle ply furnish 1 used without any filler. The middle ply furnish is used to produce folding box board grade where particularly fast dewatering is required. In each case the target grammage is 80 gsm.

Cationic polyacrylamide is dosed into the process at 150 g/tonne before the centriscreen and 300 g/tonne of different silicas were dosed after the screen. In the test high shear was simulated using a high shear zone of 1500 rpm for 30 seconds in order to provide a centriscreen effect and for a low shear zone a shearing rate of 500 rpm was used. The silicas used with the coated freesheet were polysilicate microgel, conventional colloidal silica, a borosilicate and polysilicate composition of the present invention (8% silica composition).

The 8% silica composition of the present invention was prepared as follows: 50 grams of polysilicate microgel was mixed with magnetic stirrer slowly. Conventional colloidal polysilicate was dosed 50 grams drop wise so that pH was adjusted between 1,8-2,0 by adding concentrated sulphuric acid when needed. 10% polysilicate composition was prepared as above but polysilicate micro gel and conventional colloidal polysilicate were used at 35.71 grams and 64.29 grams respectively. 8% and 10% compositions were used in coated freesheet and middle ply furnish cases respectively. Polysilicate micro gel solution with and without aluminum has been prepared according to EP 1240104. Formation (beta formation), First pass retention, Filler retention (only from coated freesheet furnish) and dewatering were recorded. All results are the average of 10 repeats.

Test 1: Coated Freesheet Furnish

TABLE 1

Formation, first pass retention and filler retention values when using a cationic polyacrylamide.

| | Formation, g/m$^2$ | First pass retention, % | Filler retention, % |
|---|---|---|---|
| Polysilicate Microgel 1 | 9.3 | 62.8 | 21.4 |
| Colloidal Polysilicate | 7 | 58.8 | 16.3 |
| Composite (8%) | 8.5 | 63.8 | 23.5 |

The polysilicate composition of the present invention has better retention values than conventional colloidal polysilicate but the performance compared to polysilicate micro gel is more or less similar. Conventional colloidal polysilicate has the best formation and the polysilicate micro gel is the poorest.

FIG. 1 shows dewatering values when using cationic polyacrylamide with siliceous material selected from conventional colloidal polysilicate, polysilicate micro gel and 8% polysilicate composition of the present invention.

It can be seen that the polysilicate composition of the present invention has the fastest dewatering performance.

TABLE 2

Formation, first pass retention and filler retention values when used when a different cationic polyacrylamide was used.

| | Formation, g/m$^2$ | First pass retention, % | Filler retention, % |
|---|---|---|---|
| Structured Silica 1 | 9.0 | 65.1 | 23.2 |
| Composite (8%) | 9.0 | 67.8 | 25.2 |

The polysilicate composition of the present invention has slightly better retention performance than found when using the borosilicate. Formation readings are equivalent.

Figure 2:
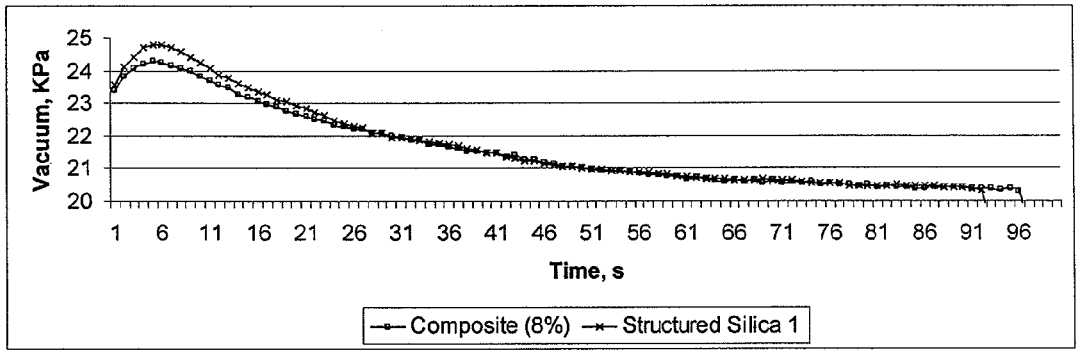
FIG. 2: a graph of dewatering values when using a cationic polymer other than polyacrylamide with siliceous material selected from an 8% polysilicate composition and structured silica.

FIG. 2 shows the dewatering values analogous to FIG. 1 but using a different cationic polymer.

The aqueous composition of the present invention has equal dewatering performance with borosilicate.

Test 2: Middle Ply Furnish

TABLE 3

Formation and first pass retention performance of polysilicate micro gel, conventional colloidal polysilicate and aqueous polysilicate composition of the present invention.

| | Formation, g/m$^2$ | First pass retention, % |
|---|---|---|
| Polysilicate Microgel 1 | 8.8 | 95.7 |
| Colloidal Polysilicate | 9.9 | 96.0 |
| Composite (10%) | 9.3 | 96.5 |

There is no significant difference in first pass retention values between micro gel, conventional colloidal silica and the composition of the present invention.

Figure 3:
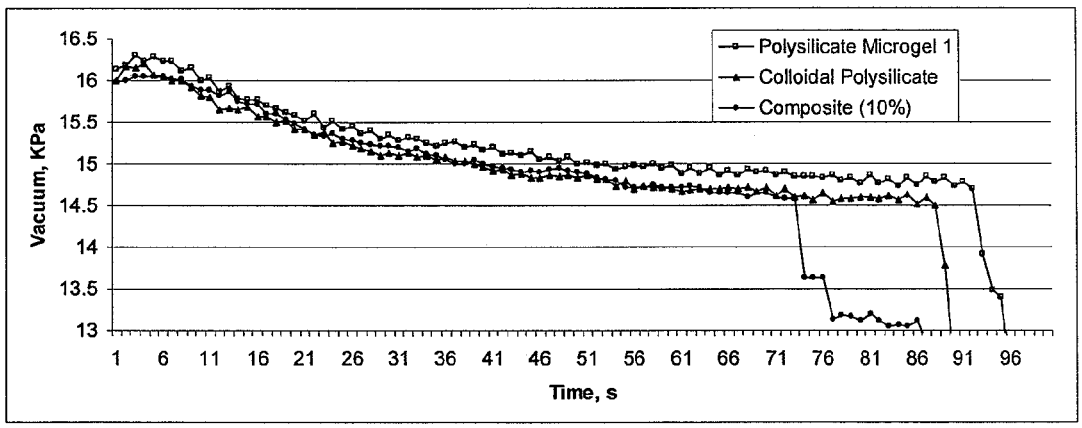
FIG. 3: a graph of dewatering values using siliceous material selected from microgel, conventional colloidal, and a 10% polysilicate composition.

FIG. 3 shows the dewatering values using siliceous material selected from microgel, conventional colloidal silica and composition of the present invention.

The composition of the present invention has the fastest dewatering performance.

TABLE 4

Formation and first pass retention performance of structured polysilicate, borosilicate and aqueous composition of the present invention.

| | Formation, g/m$^2$ | First pass retention, % |
|---|---|---|
| Structured Silica 2 | 9.9 | 95.3 |
| Structured Silica 1 | 9.6 | 95.6 |
| Composite (10%) | 9.3 | 96.5 |

Figure 4:
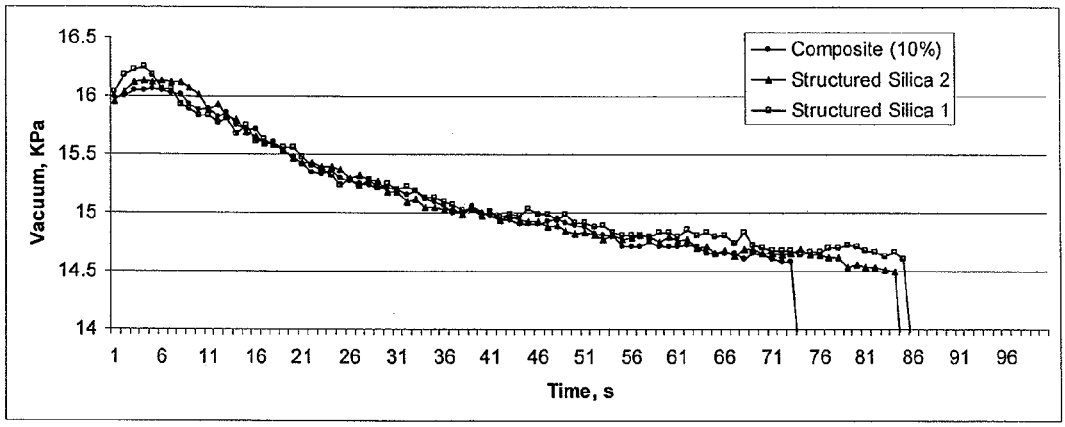
FIG. 4: a graph of dewatering performance using siliceous material selected from an aqueous composition of 10% polysilicate composition, structured silica, and borosilicate.

FIG. 4 shows the dewatering performance using siliceous material selected from aqueous composition of the present invention, structured silica, borosilicate.

Formation and first pass retention performance of structured polysilicate, borosilicate and acres composition of the present invention are equal.

Aqueous composition of the present invention has the fastest dewatering performance.

On the basis of these MBF studies it can be seen that polysilicate composition of the present invention has a superior application performance by comparison to its raw materials—conventional colloidal silica and polysilicate micro gel. The aqueous composition of the present invention also seems to have equal or better performance in comparison to borosilicate and structured silica.

EXAMPLE 3

This test is a MBF study employing an uncoated freesheet pulp furnish taken from a mixing chest and using clear filtrate as the dilution water. The filler used was FS 240 (PCC) and the loading was 40%. The target the grammage was 80 gsm.

The addition points are as follows

TABLE 5

Addition points.

| | Prescreen | Dose g/t | Postscreen | Dose g/t |
|---|---|---|---|---|
| 1 | PAM | 200 | | |
| 2 | PAM | 200 | Structured silica 1 | 500 |
| 3 | PAM | 200 | Structured silica 2 | 500 |
| 4 | PAM | 200 | Structured silica 3 | 500 |
| 5 | PAM | 200 | Compo2 Al | 500 |
| 6 | PAM | 200 | Compo3 Al | 500 |
| 7 | PAM | 200 | Compo2 | 500 |
| 8 | PAM | 200 | Compo3 | 500 |
| 9 | PAM | 200 | Compo4 Al | 500 |
| 10 | PAM | 200 | Compo4 | 500 |
| 11 | PAM | 200 | Polysilicate microgel 1 | 500 |
| 12 | PAM | 200 | Colloidal polysilicate | 500 |
| 13 | PAM | 200 | Polysilicate microgel 2 | 500 |

Cationic polyacrylamide (PAM) was dosed 200 g/t pre screen and different silica microparticles 500 g/t (active $SiO_2$) post screen. High shear zone was 1500 rpm for 30 seconds in order to simulate the effect of a centriscreen and simulation of the low shear zone was achieved using 500 rpm (pre centriscreen). The different silica composites were prepared as follows:

TABLE 6

Preparation the aqueous polysilicate compositions on the present invention.

| Composite | grams of polysilicate microgel | grams of conventional colloidal polysilicate | reaction pH | Al added |
|---|---|---|---|---|
| Compo2 | 50 | 150 | 5 | no |
| Compo2 Al | 50 | 150 | 5 | yes |
| Compo3 | 50 | 150 | 3.5 | no |
| Compo3 Al | 50 | 150 | 3.5 | yes |
| Compo4 | 100 | 100 | 1.9 | no |
| Compo4 Al | 100 | 100 | 1.9 | yes |

Column Al added describes whether or not aluminum has been used in micro gel solution preparation. Polysilicate micro gel solution with and without aluminum has been prepared according to EP 1240104. Note that 5 N sulphuric acid has been used in preparation of these composite samples. Borosilicate, and two different types of structured polysilicate SPS 1 and SPS 2 and conventional polysilicate were used as the control samples.

Formation (beta formation), First pass retention, Filler retention and dewatering were recorded. All results are the average of 10 repeats.

TABLE 7

Formation, first pass retention and filler retention values.

| | Formation, $g/m^2$ | First pass retention, % | Filler retention, % |
|---|---|---|---|
| PAM | 5.9 | 67.7 | 30.3 |
| Structured Silica 1 | 11.3 | 90.6 | 71.0 |
| Structured Silica 2 | 11.7 | 89.0 | 72.9 |
| Structured Silica 3 | 10.9 | 87.9 | 70.1 |
| Composite (Compo2 Al) | 11.5 | 88.6 | 72.0 |
| Composite (Compo3 Al) | 11.8 | 90.5 | 71.6 |
| Composite (Compo2) | 12.3 | 88.3 | 72.3 |
| Composite (Compo3) | 11.6 | 88.7 | 72.8 |
| Composite (Compo4 Al) | 12.0 | 91.4 | 73.9 |
| Composite (Compo4) | 12.0 | 91.2 | 73.6 |
| Polysilicate Microgel 1 | 13.8 | 94.0 | 77.5 |
| Colloidal Polysilicate | 10.6 | 87.0 | 70.6 |
| Polysilicate Microgel 2 | 14.4 | 93.2 | 78.0 |

The best retention values and worst formation values are achieved with polysilicate microgel solutions (with and without aluminum). Microgel solutions have good potential to form flocs. Generally the composites have equal or better performance than the control samples. Compo3 and Compo4 are the best composites.

Figure 5:
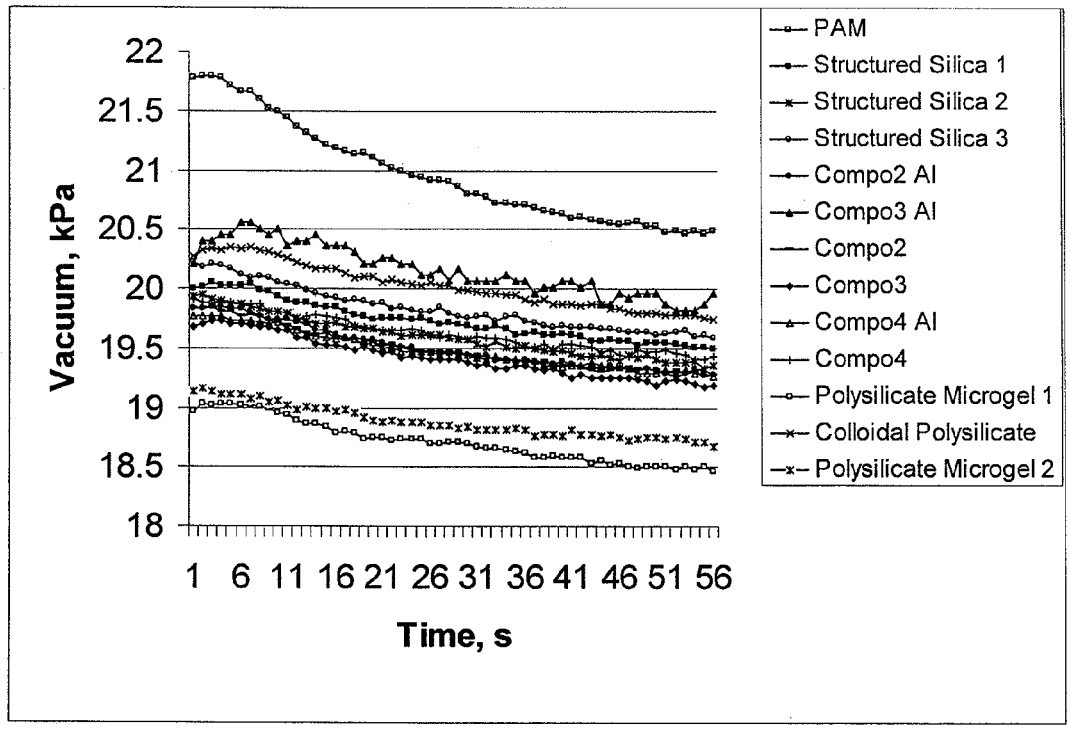
FIG. 5: a graph of dewatering performance of multiple microgel samples.

FIG. 5 shows the dewatering performance.

FIG. 5 shows that micro gel samples have fastest dewatering. Composites have equal or faster dewatering than the control samples. The fastest dewatering can be seen using composite samples Compo3 and Compo4 Al.

TABLE 8

Formation, first pass retention and filler retention of two composites, micro gel and conventional colloidal silica.

| | Formation, $g/m^2$ | First pass retention, % | Filler retention, % |
|---|---|---|---|
| Polysilicate Microgel | 13.8 | 94.0 | 77.5 |
| Colloidal Polysilicate | 10.6 | 87.0 | 70.6 |
| Composite (Compo3) | 11.6 | 88.7 | 72.8 |
| Composite (Compo4 Al) | 12.0 | 91.4 | 73.9 |

The two composites (Compo3 and Compo4 Al) have better retention performance than conventional colloidal silica. Micro gel exhibits the highest retention values.

Figure 6:
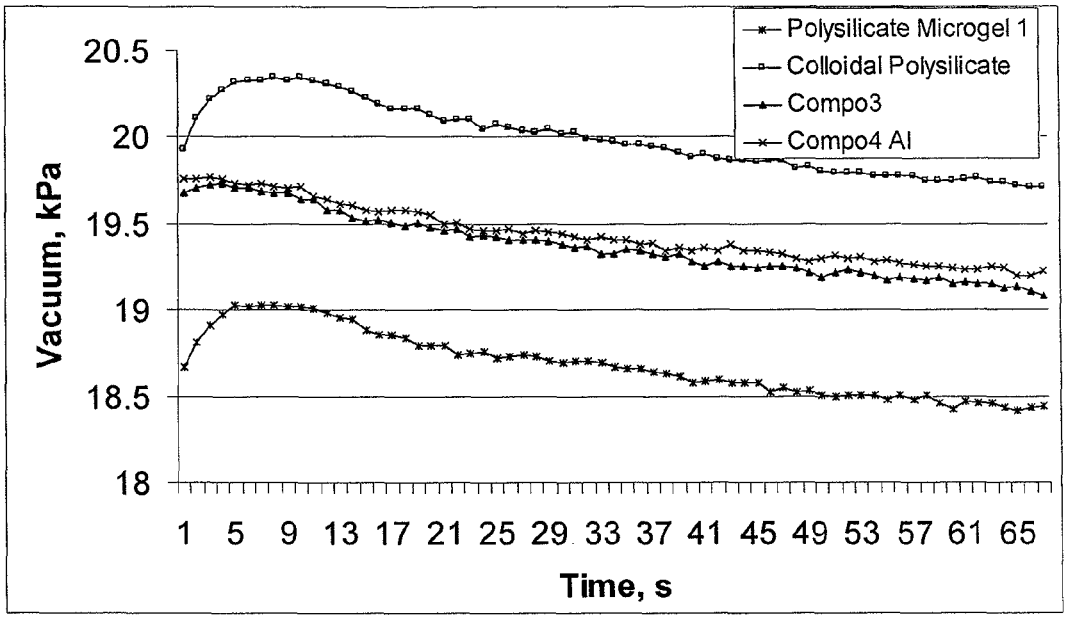
FIG. 6: a graph of dewatering performance of two composites, a microgel, and a conventional polysilicate.

FIG. 6 demonstrates the dewatering performance of two composites, micro gel and conventional polysilicate. Micro gel is the fastest dewatering and conventional colloidal polysilicate is the slowest.

TABLE 9

Formation, first pass retention and filler retention of two best composites and the competitors' microparticles.

| | Formation, $g/m^2$ | First pass retention, % | Filler retention, % |
|---|---|---|---|
| Structured Silica 1 | 11.3 | 90.6 | 71.0 |
| Structured Silica 2 | 11.7 | 89.0 | 72.9 |

TABLE 9-continued

Formation, first pass retention and filler retention of two best composites and the competitors' microparticles.

| | Formation, $g/m^2$ | First pass retention, % | Filler retention, % |
|---|---|---|---|
| Structured Silica 3 | 10.9 | 87.9 | 70.1 |
| Composite (Compo3) | 11.6 | 88.7 | 72.8 |
| Composite (Compo4 Al) | 12.0 | 91.4 | 73.9 |

By comparison to samples borosilicate and two structured polysilicates, the two composites tested have equal or better retention performance as indicated in Tables 8 and 9 above.

Figure 7:
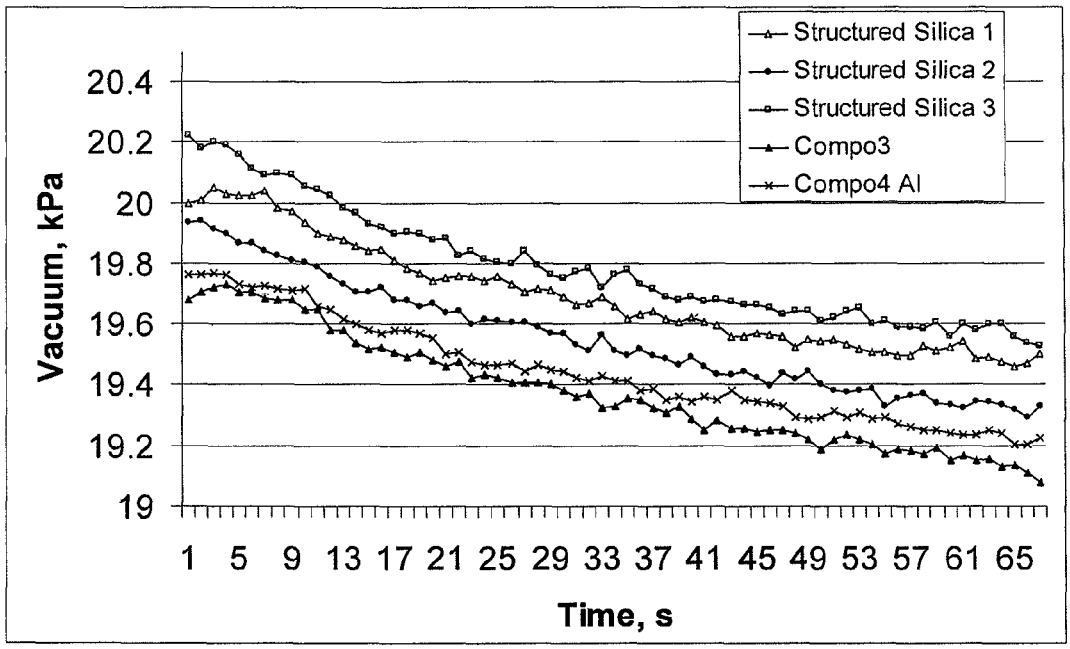
FIG. 7: a graph of dewatering performance of two composites, structured silica, and borosilicate products.

FIG. 7 indicates the dewatering performance of two composites and the structured silica and borosilicate products.

calibrated pH probe, the pH was adjusted from 8.3 to 7.0 with sulfuric acid. At pH 7.0 the mixture of 50:50 colloidal silica and silica micro-gel was reacted for 20 minutes. During the 20 minutes an aggressive vortex was maintained in the reaction vessel to ensure proper mixing. After 20 minutes, the pH was dropped to 2.0 using sulfuric acid and a calibrated pH probe.

Individually, colloidal silica and silica micro-gel products were evaluated for S-value and compared to composite silica generated at various times and various pH. Results of a number of S value measurements are shown in Table 10. Based on S value data, the best composite silica was reacted at 7 pH for 20 minutes. The S value is lower than theoretical or expected values which imply a unique material has been created. S value determination is a useful tool in determining the structure of the silicas used in papermaking applications.

TABLE 10

S values of composite silicas at different pH with constant reaction times.

| | pH | | | | | | | | | |
|---|---|---|---|---|---|---|---|---|---|---|
| | 2 | 3.5 | 5 | 7 | 8.1 | 9 | 9.5 | 10 | | |
| | RXN time | | | | | | | | | |
| | 20 | 20 | 20 | 20 | 20 | 20 | 20 | 20 | micro gel | colloidal silica |
| S time | 163 | 156.1 | 182.4 | 210.6 | 165.7 | 151.2 | 140.9 | 137.2 | 122.3 | 177.5 |
| N | 1.6 | 1.6 | 1.8 | 2.1 | 1.7 | 1.5 | 1.4 | 1.4 | 1.2 | 2 |
| C | 0.2 | 0.1 | 0.2 | 0.2 | 0.2 | 0.1 | 0.1 | 0.1 | 0.1 | 0.2 |
| S Value | 47.4 | 49.8 | 42 | 37.3 | 46.4 | 52 | 57.7 | 60.3 | 13.1 | 64.3 |
| Theo | 38.7 | 38.7 | 38.7 | 38.7 | 38.7 | 38.7 | 38.7 | 38.7 | | |
| Diff | 8.6 | 11.1 | 3.3 | −1.4 | 7.7 | 13.2 | 19 | 21.6 | | |

TABLE 11

| | 0 | 0.25 | 0.5 | 0.75 | 1 | 1.25 | 1.5 | 2 |
|---|---|---|---|---|---|---|---|---|
| Silica micro-gel | 48.00 | 27.57 | 23.47 | 21.63 | 21.00 | 20.31 | 19.85 | |
| Colloidal (BMA 0) | 48.00 | 45.37 | 42.25 | 43.38 | 41.31 | 37.12 | 31.79 | |
| Colloidal (1033) | 48.00 | 39.34 | 39.00 | 38.37 | 36.31 | 33.53 | 33.19 | |
| 11% U.S. | 48.00 | 39.34 | 35.97 | 28.57 | 29.00 | 24.32 | 23.84 | |
| 8% U.S. | 48.00 | 40.47 | 36.72 | 30.17 | 29.47 | 29.62 | 27.35 | 23.31 |
| Theoretical | | 40.92 | 37.555 | 37.9425 | 36.23 | 32.9175 | 28.805 | |

This shows that the two composites have faster dewatering performance than that of borosilicate and structured silicate products.

Composite samples corresponding to the Compo4 & Compo4 Al in this study have been shown to have even better performance than microgel or conventional polysilicate.

EXAMPLE 4

A composite silica was prepared with the following raw materials: colloidal silica, a silica micro-gel and sulfuric acid. Typically, the colloidal silica has an S value higher than 60 whereas, the silica micro-gel has an S-value lower than 20. The raw materials excluding the sulfuric acid should be tested for S value to determine the degree of structure for each.

Figure 8:
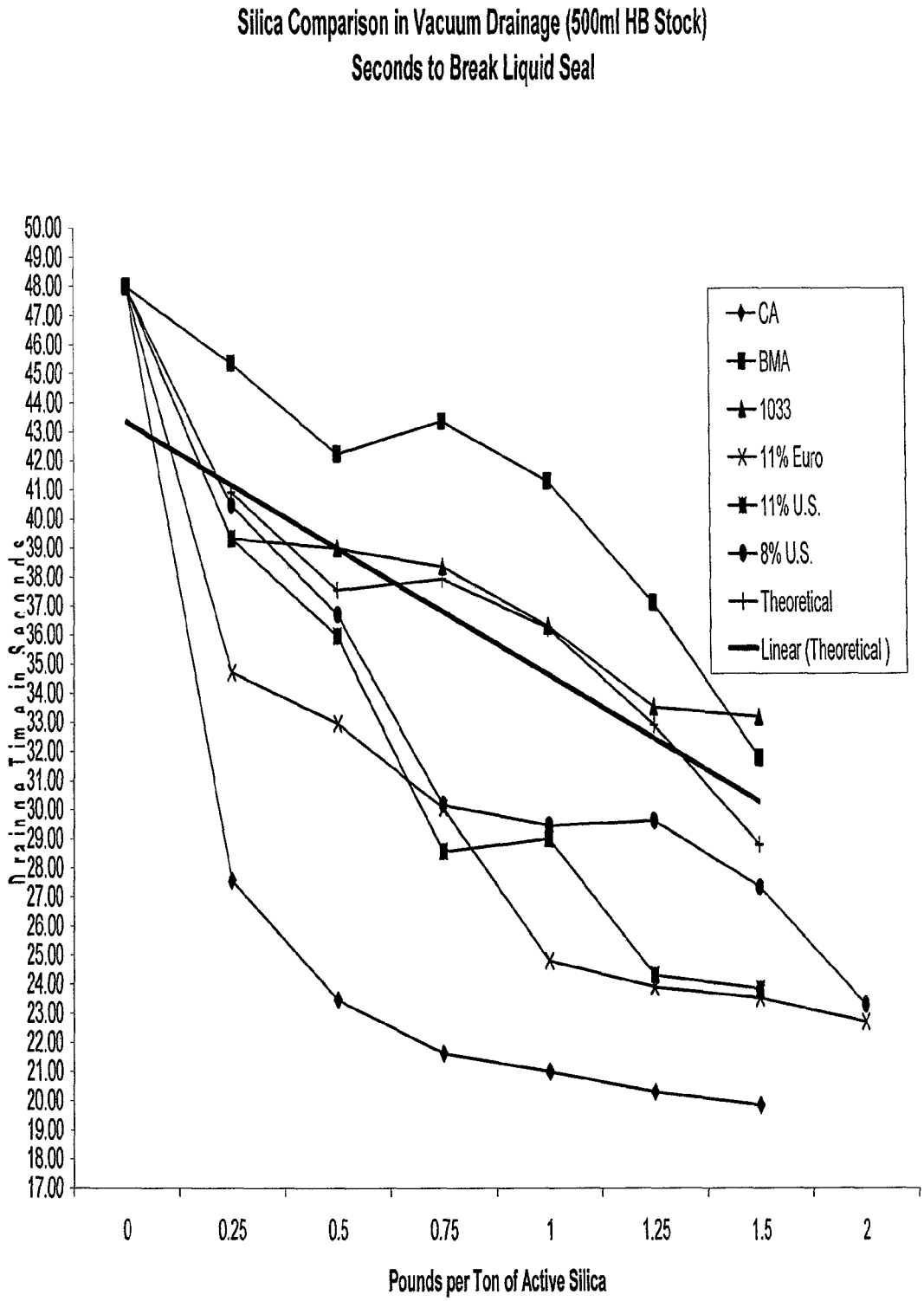
FIG. 8: a graph comparing vacuum drainage of silica containing samples.

The raw materials were tested for S value as per method detailed in Table 11. The colloidal silica at 50% volume was agitated with a vortex while the silica micro-gel was introduced to the reaction vessel at 50% volume. While using a Pulp used to produce uncoated freesheet with 10% post consumer waste was prepared to a freeness of 400-300 and diluted to 0.8% consistency for laboratory experimentation. A 500 ml aliquot of the 0.8% consistency stock is mixed at 1000 rpm. A cationic flocculant and composite silica is added in 30 second intervals during mixing. The cationic flocculant is added at 0.75 pounds per ton as received with composite silica following at 0.25, 0.5, 0.75, 1.0, 1.5, 2.0 pounds per ton. After treatment, the stock is filtered through a Buchner funnel under vacuum with a 541 Whatman filter paper and timed until the liquid seal breaks. At that time the vacuum drainage is recorded. A stop watch capable of 1/100 seconds is used in testing and the vacuum results recorded in seconds. The results are shown in FIG. 8.

The invention claimed is:

1. An aqueous polysilicate composition comprising a polysilicate microgel based component in association with particles derived from colloidal polysilicate, wherein the polysilicate composition has a pH of between 1.5 and 5.5, and the polysilicate composition has a volume average particle size of 30 nm to 100 nm.

2. The composition according to claim 1 in which the polysilicate composition has a viscosity of below 500 mPa·s measured using a Brookfield RVT viscometer using spindle 2 at 100 rpm at 25° C.

3. The composition according to claim 1 in which the pH is between 3 and 5.

4. The composition according to claim 1 in which the pH is between 1.5 and 3.

5. The composition according to claim 1 in which the viscosity is below 150 mPa·s measured using a Brookfield RVT viscometer using spindle 2 at 100 rpm at 25° C.

6. The composition according to claim 1 in which the polysilicate composition has an active $SiO_2$ content of at least 4% by weight.

7. A process for preparing an aqueous polysilicate composition comprising mixing an aqueous colloidal polysilicate with an aqueous phase of a polysilicate microgel, wherein the aqueous colloidal polysilicate is added to the aqueous phase of the polysilicate microgel followed by adjustment of the pH to between 1.5 and 5.5.

8. The process according to claim 7 in which the polysilicate microgel has an active $SiO_2$ content of no more than 2% by weight.

9. The process according to claim 7 in which the aqueous colloidal polysilicate has an active $SiO_2$ content of at least 15% by weight.

10. The process according to claim 7 in which the aqueous colloidal polysilicate has a surface area below 1000 $m^2/g$.

11. The process according to claim 7 in which adjustment of the pH employs a strong mineral acid.

12. The process according to claim 7 in which a period of at least 10 minutes elapses before adjustment of the pH.

13. The process according to claim 7 in which a ratio of polysilicate microgel to aqueous colloidal polysilicate is between 1:5 and 1:0.2.

14. A process of making paper or paperboard comprising forming a cellulosic suspension, flocculating the suspension, draining the suspension on a screen to form a sheet and then drying the sheet, in which the suspension is flocculated using a flocculation system comprising i) a non-ionic, an anionic, a cationic polymer or an amphoteric polymer, and ii) the aqueous polysilicate composition of claim 1 or, optionally, an aqueous dilution of said aqueous polysilicate composition.

15. The process according to claim 14 in which the components of the flocculation system are introduced into the cellulosic suspension sequentially.

16. The process according to claim 14 in which the non-ionic polymer, the anionic polymer, the cationic polymer or the amphoteric polymer is added into the cellulosic suspension before the aqueous polysilicate composition.

17. The process according to claim 14 in which the non-ionic polymer, the anionic polymer, the cationic polymer or the amphoteric polymer is a synthetic polymer exhibiting a weight average molecular weight of at least 500,000.

18. The process according to claim 14 in which a cationic starch is added into the cellulosic suspension.

19. The process according to claim 14 in which the cellulosic suspension is flocculated by the addition of the cationic polymer or the amphoteric polymer and then subjected to mechanical degradation resulting in the breakdown of the flocs so formed followed by the addition of the aqueous polysilicate composition.

* * * * *